United States Patent [19]

Wegener et al.

[11] 4,434,222

[45] Feb. 28, 1984

[54] METHOD OF FORMING INFRARED-SENSITIVE PHOTOCONDUCTORS OF CADMIUM SALT CRYSTALLITES

[75] Inventors: Mary J. Wegener, San Jose; Morris Feinleib, Mountain View, both of Calif.

[73] Assignee: Benson, Inc., San Jose, Calif.

[21] Appl. No.: 263,953

[22] Filed: May 15, 1981

[51] Int. Cl.[3] ..... G03G 5/087

[52] U.S. Cl. ..... 430/135; 430/94

[58] Field of Search ..... 430/94, 135

[56] References Cited

U.S. PATENT DOCUMENTS

| | | | |
|---|---|---|---|
| 3,379,527 | 4/1968 | Corrsin et al. | 430/94 |
| 3,589,928 | 6/1971 | Sawato et al. | 430/94 |
| 4,366,222 | 12/1982 | Feinleib | 430/127 |

FOREIGN PATENT DOCUMENTS

| | | |
|---|---|---|
| 1120091 | 7/1968 | United Kingdom . |
| 1503385 | 3/1978 | United Kingdom . |
| 1526753 | 9/1978 | United Kingdom . |
| 1551190 | 8/1979 | United Kingdom . |
| 1554701 | 10/1979 | United Kingdom . |

*Primary Examiner*—Richard L. Schilling
*Assistant Examiner*—John L. Goodrow
*Attorney, Agent, or Firm*—Alan H. MacPherson; Steven F. Caserza; Thomas S. MacDonald

[57] ABSTRACT

A photoconductor material having high sensitivity to infrared light is provided therefore making it suitable for use in laser printers. The photoconductor of this invention has a dark decay of approximately 40 volts/-second, thereby enhancing the use of this invention with infrared laser printers as compared to prior art infrared sensitive photoconductors. The photoconductor of this invention comprises cadmium sulfide (CdS), cadmium selenide (CdSe), cadmium carbonate ($CdCO_3$) and cadmium oxide (CdO) in a binder, and preferably also includes a small amount of copper dopant. The photoconductor of this invention is prepared by adding ammonia to a suspension of cadmium sulfide/cadmium carbonate in water and then adding hydrogen selenide to this suspended solution. The ammonia provides a means for retaining the selenide in the solution for an increased period, thus allowing the selenide to remain in the solution for a time sufficient to allow the selenide to react with the small amount of cadmium ion in solution at any time, thereby providing a suspension of intimately mixed $CdSCdSeCdCO_3$ crystallites.

8 Claims, 1 Drawing Figure

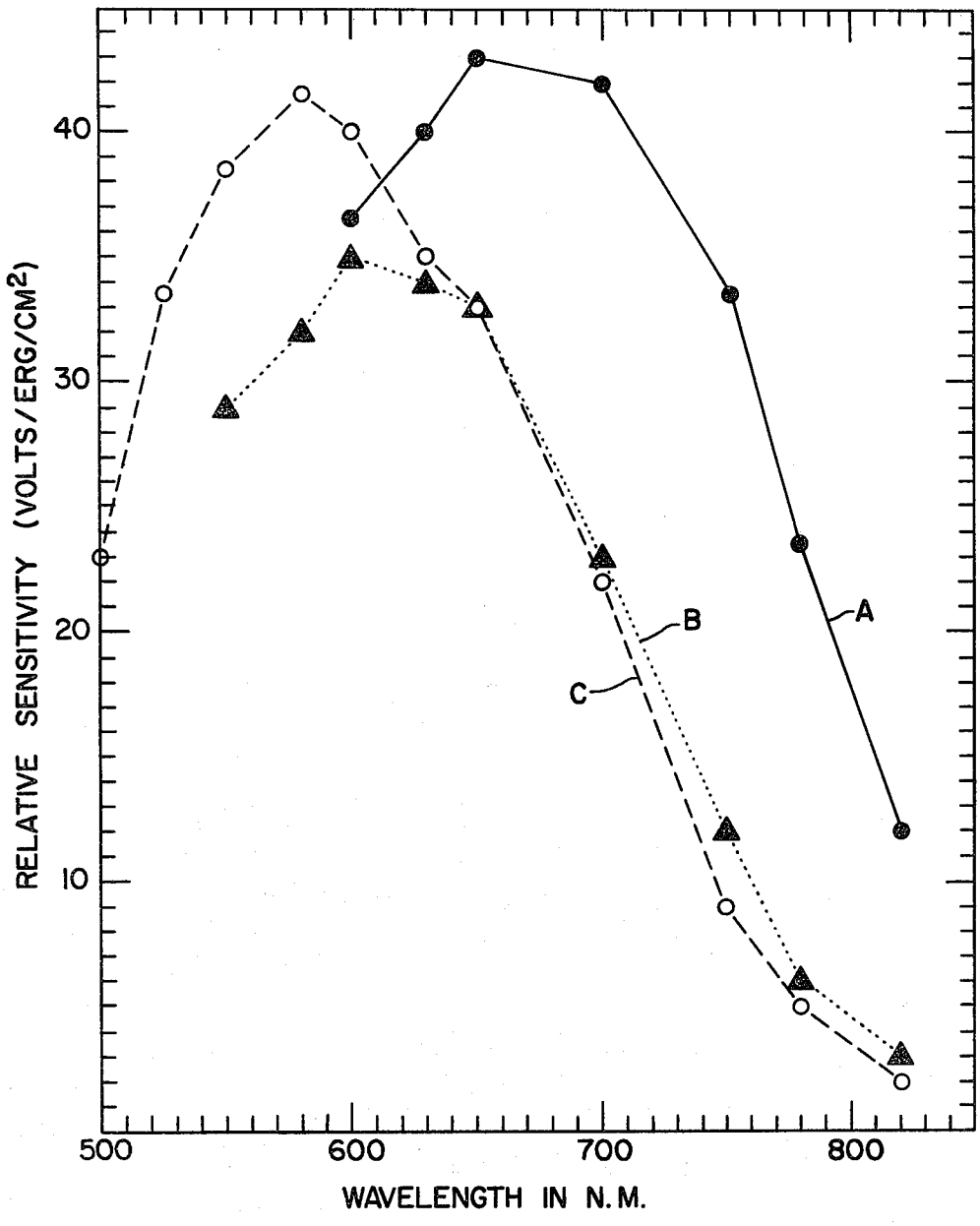
RELATIVE SENSITIVITY (VOLTS/ERG/CM2)
40
30
20
10
500
600
700
800
WAVELENGTH IN N.M.
A
B
C

METHOD OF FORMING INFRARED-SENSITIVE PHOTOCONDUCTORS OF CADMIUM SALT CRYSTALLITES

BACKGROUND OF THE INVENTION

1. Field of the Invention

This invention relates to photoconductors and more specifically to photoconductors used for coating a substrate for use in electrophotographic copy machines and computer printers utilizing infrared light and to a method for making these photoconductors.

2. Description of the Prior Art

Two general types of electrophotographic processes for producing copies of information (whether stored in computer memory or on paper) are widely used. The first method is known as the "charge transfer process" and the second is known as the "toned image transfer process".

In the charge transfer process, an electric charge is put on the surface of a cylindrical drum, the surface of which is coated with a photoconductive material. Selected regions on the surface of the charged drum, corresponding to those regions which are to appear untoned or white on the printed copy, have the charge stored thereon erased by the application of light, thus causing stored charge to be discharged to the underlying conductive drum. A dielectric paper is then placed on the drum, and the remaining charge is transferred from the surface of the drum to the dielectric paper. With selected regions on the paper now charged, a toner is applied to the paper, and adheres to those regions on the paper which are charged. The toner is then "fixed" (i.e., made permanent, usually by heating), thus providing a reproduced image on the dielectric paper corresponding to the pattern of charge on the surface of the drum.

In the toned image transfer process, the surface of a photoconductive drum is first charged with an electric potential, and selected regions of this surface, corresponding to those regions of the printed copy which are to appear untoned or white, have the electrical charge removed by the application of light, thus causing stored charge to be discharged to the underlying conductive drum. Toner is then directly applied to the drum, and adheres to those portions of the drum which remain charged. Plain paper is then placed on the drum, with the toned image formed on the drum being transferred to the paper. The toned image on the paper is then fixed, resulting in an electrophotographic copy remaining on the paper.

Photoconductors used on the surface of drums in such typical copying apparatus are required to reproduce "red color information" (i.e. red color on an original) in order that red information will appear on the copy as black or a shade of gray. Therefore, prior art photoconductors are designed to have relatively low sensitivity (the rate of decay of stored charge for a given intensity of light) at the red end of the visible spectrum, as well as in the infrared region, in order that the red portion of the spectrum will not affect the photoconductor, as does white light. In contrast, for use in laser printers, it is necessary to utilize a photoconductor for coating the surface of the drum which has enhanced sensitivity in the red and infrared (IR) regions. It is particularly desirable to utilize a photoconductor which is sensitive in the near infrared region within the range of approximately 750–850 nanometers in conjunction with laser diodes emitting infrared light within this range. In this manner, the infrared light emitted from the infrared laser diodes is used to selectively remove charge from selected regions of the coated surface of the photoconductor drum.

Photoconductors are well known in prior art. In particular there are several patents and publications describing the preparation of cadmium sulfide/cadmium carbonate in photoconductors, including U.S. Pat. Nos. 3,494,789; 3,975,306; and 3,704,123. However, the most closely related prior art is application Ser. No. 204,966 filed by Feinleib and assigned to Varian, Inc., which is hereby incorporated by reference into this application.

Cadmium sulfide based photoconductors have a very high dark conductivity, thus making them difficult to use. "Dark conductivity" is the conductivity of the photoconductor when not exposed to light. A high dark conductivity causes a high dark decay wherein charges stored on a dark (i.e., not exposed to light) photoconductive surface dissipate or decay rapidly, thus preventing proper operation of the printing machine. Furthermore, the use of cadmium sulfide in a binder is not practical for use in Xerographic copy machines because the resulting photoconductive material has a memory, which retains previous electric charge, thus causing "print-through" of a previous copy. Electrically neutralizing the charge on the photoconductive drum is generally not effective in eliminating the memory of cadmium sulfide photoconductors. Furthermore, cadmium sulfide photoconductors must be used in extremely thin layers because cadmium sulfide absorbs light to only shallow depths. With the use of very thin layers of cadmium sulfide, insufficient charge is sustained on the surface of the photoconductor, thus preventing good imaging on the resulting copy. In thicker layers of cadmium sulfide based photoconductors, an insufficient amount of the charge stored on the surface of the photoconductor is removed by the application of light to provide good imaging on the resulting copy.

It is known in the prior art that the sensitivity of cadmium sulfide based photoconductors in the red region (both visible red and infrared) can be increased by increasing the concentration of selected dopants within the photoconducting material (such dopants are typically copper and chloride) and by replacing a portion of the cadmium sulfide with cadmium selenide. However, both of these prior art measures of increasing the red sensitivity of cadmium sulfide based photoconductors will increase the photoconductor's dark conductivity, with a resultant increase in the photoconductor's dark decay, thus making the photoconductor unsuitable for use in copy machines.

Another prior art photoconductor utilizes a cadmium sulfide/cadmium carbonate base which also contains a small amount of cadmium oxide. Such a photoconductor is described in co-pending U.S. patent application Ser. No. 204,966. The photoconductive material disclosed in this co-pending application overcomes certain limitations of prior art cadmium sulfide/cadmium carbonate photoconductors and comprised a cadmium sulfide/cadmium carbonate type photoconductor with increased charge acceptance, reduced memory effects, more dependable performance in high humidity environments, and increased stability of speed over long periods of time as compared to prior art cadmium sulfide based photoconductors. The photoconductor of the abovementioned co-pending patent application has permitted the use of highly photosensitive cadmium sulfide as an electrophotographic medium, due to its ability to absorb light to a good depth (i.e., approximately 20–35 microns), thereby allowing layers of photoconductive material to be formed on a drum surface to a sufficient thickness to sustain sufficient surface charge on the photoconductor after charging, thus resulting in a useful electrophotographic photoconductor. In addition, such a photoconductor allows "memory effects" (i.e., retained previous electric charge causing "print through" of a previous copy) to be eliminated by proper machine designs, which includes pre-exposing the photoconductor to illumination thereby discharging all electric charge retained by the photoconductor. Of importance, the mere electrical neutralization of surface charges on the photoconductor drum is insufficient to completely eliminate this phenomenon. Unfortunately, the infrared sensitivity of the photoconductor disclosed in the co-pending application is quite low, but is somewhat increased by the methods described above, (increased dopants and the use of cadmium selenide) subject to increased dark conductivity.

Still another prior art photoconductor utilizes a cadmium selenide base. The cadmium selenide photoconductor is more sensitive to infrared light than cadmium sulfide photoconductors, yet has a high dark conductivity, thus making it relatively ineffective for use in copy machines.

Other prior art photoconductors which are sensitive in the infrared region include arsenic triselenide and tellurium doped arsenic triselenide. However, each of these photoconductors has high dark conductivity, great temperature sensitivity, and is inherently unstable, thus making them difficult to use in copy machines. In addition, these photoconductors are difficult to fabricate and can only be used in one charging mode (i.e., they are not bipolar). A bipolar photoconductor is one which may be charged alternatively either positively or negatively, and the charge may be removed at selected regions on the photoconductor surface by the application of light.

Thus, to overcome these limitations of prior art photoconductors, it is desired to provide a photoconductor which is highly sensitive in the infrared region, and yet does not exhibit excessively high dark conductivity.

SUMMARY OF THE INVENTION

In accordance with this invention a photoconductor material having high sensitivity to infrared light is provided therefore making it suitable for use in laser printers. The photoconductor of this invention has a dark decay of approximately 40 volts/second, thereby enhancing the use of this invention with infrared laser printers as compared to prior art infrared sensitive photoconductors. The photoconductor of this invention comprises cadmium sulfide (CdS), cadmium selenide (CdSe), cadmium carbonate ($CdCO_3$) and cadmium oxide (CdO) in a binder, and preferably also includes a small amount of copper dopant. The photoconductor of this invention is prepared by adding ammonia to a suspension of cadmium sulfide/cadmium carbonate in water and then adding hydrogen selenide to this suspended solution. The ammonia provides a means for retaining the selenide in the solution for an increased period, thus allowing the selenide to remain in the solution for a time sufficient to allow the selenide to react with the small amount of cadmium ion in solution at any time, thereby providing a suspension of intimately mixed $CdSCdSeCdCO_3$ crystallites.

DESCRIPTION OF THE DRAWING

The single FIGURE is a graphical representation of the relative sensitivity versus wavelength for the photoconductor fabricated in accordance with the present invention and for two prior art cadmium carbonate/cadmium sulfide based photoconductors.

DETAILED DESCRIPTION OF THE INVENTION

The photoconductor of this invention having enhanced sensitivity to infrared radiation as compared to prior art photoconductors is formed by the following process. In one embodiment, a first solution is prepared by mixing 1500 grams of $Cd(NO_3)_2.4H_2O$ (cadmium nitrate) with five grams $CuCl_2.2H_2O$ (cupric chloride) and sufficient deionized water to make a volume of 2700 milliliters. The cupric chloride provides a doping concentration in the final photoconductor of approximately 0.6% copper atoms per cadmium atom, assuming no loss of any copper or cadmium during the process. The use of copper as a dopant in cadmium sulfide based photoconductors shifts the photosensitive peak toward the infrared region. However, the use of copper dopant in such prior art photoconductors does not cause a sufficient shift in the sensitivity peak to make such prior art photoconductors sufficiently sensitive in the infrared region for use in copy machines. The use of copper as a dopant also decreases the sensitivity of the photoconductor. To compensate for this decreased sensitivity caused by the copper dopant, chloride dopant is used. The chloride dopant increases the sensitivity, while at the same time increasing the dark conductivity. For these reasons, relatively small amounts of copper and chloride are used as dopants.

A second solution is formed comprising approximately 480 grams of $NH_4HCO_3$ (ammonium bicarbonate), 360 ml concentrated $NH_4OH$ (ammonium hydroxide) containing approximately 29% $NH_3$ (ammonia), and sufficient deionized water to make a 2700 ml volume of this second solution.

The 2700 ml of the first solution is mixed at room temperature with the 2700 ml of the second solution with stirring in such a way as to form very fine particles of cadmium carbonate ($CdCO_3$) in suspension. An excess of ammonium bicarbonate is utilized in order to insure nearly complete reaction of the cadmium ions to form cadmium carbonate. The above reaction is described by the following equation:

$$Cd^{++}(NO_3)_2^- + NH_4^+HCO_3^- + NH_4^+OH^- \rightarrow CdCO_3 + 2NH_4^+ + 2NO_3^- + H_2O$$

The cadmium carbonate is not separated from the slurry at this point but is aged under agitation for approximately thirty minutes. It is to be understood that this aging process is not absolutely necessary in the practice of this invention. However, if utilized, it is believed this aging process allows the reformation of the surfaces of the very fine particles of cadmium carbonate, thereby removing occluded ions from the cadmium carbonate particles, thus facilitating the later washing of the precipitates (after conversion to cadmium sulfide).

As an alternative to this procedure of using first and second solutions to precipitate $CdCO_3$ (cadmium carbonate) in the form of a slurry, the following process may be used. Eight hundred thirty-eight (838) grams of reagent-grade cadmium carbonate is mixed with 5 grams of cupric chloride in 3250 ml of deionized water. For convenience, the resulting slurry is divided among 6 ceramic grinding jars (Norton size 00, 1.13 liter capacity) containing 900 grams of grinding cylinders (Norton Burundum ½"×½"). After grinding on a ball mill for 23 hours, the slurry is transferred to a 10 liter bucket fitted with a mechanical stirrer. Of course, other suitable methods of providing a slurry of fine cadmium carbonate particles may be used.

To the cadmium carbonate suspension formed by either method above, is added 460 ml of concentrated ammonium hydroxide (29% ammonia) and, after five to ten minutes of stirring, hydrogen sulfide ($H_2S$) gas is introduced into the stirred cadmium carbonate slurry through a fritted bubbler at the rate of approximately 314 standard $cm^3$/minute for approximately 180 minutes. The use of a fritted bubbler allows good dispersion of small bubbles of hydrogen sulfide throughout the cadmium carbonate/ammonia slurry. The introduction of $H_2S$ converts approximately 65% of the cadmium carbonate to cadmium sulfide, with essentially all of the hydrogen sulfide gas introduced into the suspension being used in the formation of cadmium sulfide via the following reaction:

$$CdCO_3+2NH_4^+OH^-H_2S\rightarrow CdS\downarrow+CO_3^{--}+2NH_4^++2H_2O$$

After the above reaction occurs, the slurry contains approximately 140 grams of cadmium sulfide (CdS) and 120 grams of cadmium carbonate.

After this introduction of hydrogen sulfide and the resulting conversion of a portion of the cadmium carbonate to cadmium sulfide, two alternative procedures may be used:

Alternative Procedure I

The resulting slurry containing both cadmium sulfide and cadmium carbonate is divided in half, for convenience. One half is put through a centrifugal filter, thus separating the liquid from the precipitated cadmium carbonate/cadmium sulfide. This precipitated "cake" is washed for approximately 40 minutes in deionized water to remove salts, such as ammonium nitrate and ammonium carbonate. Some occluded chloride is removed in the liquid and during washing of the cake. The resulting wet cadmium carbonate/cadmium sulfide cake is formed into a second slurry by mixing with approximately 2500 ml of deionized water in a kitchen blender. To this slurry is added approximately 13.3 ml of a solution of deionized water containing approximately 7.388 grams $Cd(NO_3)_2.4H_2O$ (cadmium nitrate), and approximately 0.0246 grams of $CuCl_2.2H_2O$ (cupric chloride). Approximately 300 ml of reagent-grade concentrated ammonium hydroxide (approximately 29% $NH_3$) is then added to the slurry. This amount of cupric chloride will maintain approximately 0.6% doping concentration (copper atoms per cadmium atom) in the final photoconductor, assuming that no copper or cadmium is lost during the remainder of this process. This slurry is then aged for approximately thirty minutes under constant agitation. Once again, it is to be understood that the use of this aging process is not essential to the practice of this invention, however, it is believed that during this time the added cadmium may form some fresh particles of cadmium carbonate which are not coated with cadmium sulfide and upon whose surface cadmium selenide particles may later form, thus providing an intimate mixture of $CdSCdSeCdCO_3$.

At this time, hydrogen selenide gas ($H_2Se$) is introduced into the stirred slurry through a fritted bubbler at the rate of approximately 26.8 standard $cm^3$/minute for approximately 20 minutes. The amount of hydrogen selenide absorbed into the slurry is equivalent, on a molar basis, to the amount of $Cd(NO_3)_2.4H_2O$ solution added after reslurrying, as can be shown by the following chemical equation:

$$2NH_4OH+Cd(NO_3)_2+H_2Se\rightarrow CdSe+2NH_4NO_3+2H_2O$$

At this time, the slurry is again put through a centrifugal filter, and the precipitated cake comprised of approximately 70 grams of CdS (cadmium sulfide), 60 grams of $CdCO_3$ (cadmium carbonate) and 3 grams of CdSe (cadmium selenide) is washed in deionized water to remove most traces of salts (such as ammonium nitrate and ammonium carbonate) which are formed as biproducts during the process. Some occluded chloride is removed in the liquid and during washing of the cake. The remaining precipitated cake is then spin dried to remove most of the moisture. The precipitated cake is then dried in an oven having an air atmosphere at approximately 110° to 115° Centigrade for approximately 15 hours to remove substantially all remaining moisture.

Alternative Procedure II

Approximately 300 ml of concentrated ammonium hydroxide (approximately 29% $NH_3$) is added to one-half of the slurry containing both cadmium sulfide and cadmium carbonate. To this slurry is added approximately 13.3 ml of a solution of deionized water containing 7.388 grams $Cd(NO_3)_2.4H_2O$ (cadmium nitrate), 0.0246 grams $CuCl_2.2H_2O$ (cupric chloride, to maintain 0.6% doping). This slurry is then aged for approximately thirty minutes under constant agitation. Once again, it is to be understood that the use of this aging process is not essential to the practice of this invention. However, it is believed that during this time the added cadmium may form some fresh particles of cadmium carbonate which are not coated with cadmium sulfide and upon whose surface cadmium selenide particles may later form, thus providing an intimate mixture of $CdSCdSeCdCO_3$.

At this time, hydrogen selenide gas ($H_2Se$) is introduced into the stirred slurry through a fritted bubbler at the rate of approximately 26.8 standard $cm^3$/minute for approximately 20 minutes. The amount of hydrogen selenide absorbed into the slurry is equivalent, on a molar basis, to the amount of $Cd(NO_3)_2.4H_2O$ added to the suspension prior to the addition of the hydrogen selenide, as is shown by the following chemical equation:

$$2NH_4OH+Cd(NO_3)_2+H_2Se\rightarrow CdSe+2NH_4NO_3+2H_2O$$

At this time, the slurry is put through a centrifugal filter, and the precipitated cake comprised of approximately 70 grams of CdS (cadmium sulfide), 60 grams of $CdCO_3$ (cadmium carbonate) and 3 grams of CdSe (cadmium selenide) is washed with deionized water to remove most traces of salts (such as ammonium nitrate and ammonium carbonate) which are formed as biproducts during the process. Some occluded chloride is removed in the liquid and during washing of the cake. The remaining precipitated cake is then spin dried to remove most of the moisture. The precipitated cake is then dried in an oven having an air atmosphere at approximately 110° to 115° Centigrade for approximately 15 hours to remove all remaining moisture.

Remainder of Process

The dry material formed by either Alternative I or Alternative II above is then cooled, broken up to approximately a 25 mesh size, placed into shallow trays and calcined under an inert gas (one which will not react with the dry material during calcination) within the range of approximately 250°–290° C. for approximately 3–10 hours. This calcination is preferably performed at approximately 270° C. for approximately 8 hours. This calcination is preferably performed in a furnace that is evacuated and back filled and maintained with a flow of inert gas, such as nitrogen at approximately 4.5 cubic feet/hour. The use of an inert gas is desirable because if the precipitated cake is calcined in an air atmosphere, cadmium sulfate ($CdSO_4$) may form. Cadmium sulfate is hyrgoscopic, and if present in the final photoconductor, makes the photoconductor very sensitive to moisture, including the moisture contained in air. This calcination step removes any remaining water and volatile salts, such as ammonium nitrate or ammonium carbonate, and other volatile impurities which were not removed during the washing and drying process. It is believed that some chloride is also volatilized during calcination. This calcination process also thoroughly diffuses the copper dopant throughout the cadmium sulfide and cadmium selenide particles, thus making a substantially homogenous mixture of consistent doping level. This calcination step also generates a small amount of cadmium oxide by decomposition of the cadmium carbonate by the following equation:

$$CdCO_3 \rightleftharpoons CdO + CO_2 \uparrow .$$

This small amount of cadmium oxide generated during the calcination step accounts for most, if not all, of the cadmium oxide contained in the final photoconductor. The amount of cadmium oxide generated during this calcination step is within the range of approximately 0.05% to approximately 2.5%, with the preferred range of 0.2% to 1.0%. The amount of cadmium oxide generated during this calcination step is increased with increased calcination temperature and increased calcination time. Furthermore, with a gas flow inadequate to remove sufficient $CO_2$ (carbon dioxide) from the calcination atmosphere, cadmium carbonate is inhibited from decomposing to cadmium oxide, thereby decreasing the amount of cadmium oxide generated. Other factors affecting the amount of cadmium oxide in the finished product include gas flow and pressure. With insufficient gas flow during the calcination step, volatile salts which are outgassed due to the calcination temperature are not removed from the dry material. The presence of such salts and contaminants in the final photoconductor results in the photoconductor having a high dark conductivity and low sensitivity. As the amount of cadmium oxide falls below 0.05%, the sensitivity of the photoconductor decreases. Similarly, as the amount of cadmium oxide reaches greater than 2.5%, the dark decay becomes excessively high.

The calcined powder thus formed is then stored in a closed container until ready for use to prevent the introduction of moisture and contaminants. The specific method is given by way of example, and the specific quantities of chemicals used result in a photoconductor powder comprising, by weight, approximately 69% cadmium sulfide, 28.5% cadmium carbonate, 2% cadmium selenide, and 0.5% cadmium oxide, with a 0.6% mole concentration of copper dopant atoms per cadmium atom. It is to be understood that the percentages of each of these components may be varied over a wide range, as is explained later.

Of importance, it has been found that the mere mechanical mixture of cadmium sulfide, cadmium carbonate, cadmium oxide, and cadmium selenide, with or without copper and/or chloride dopant, does not provide a photoconductor which is sensitive in the infrared region. Thus, there appears to be some interaction between each of these components of the photoconductor which occurs during the aforementioned process which accounts for the specific photoconductive properties in the infrared region.

Of importance, to those skilled in the art, a wide variation of methods may be used to form the photoconductor of this invention. For example, the cadmium nitrate may be replaced by another soluble cadmium salt, preferably one having an anion capable of forming a volatilizable compound which may be later removed by heating. Similarly, the copper dopant may be supplied by the use of any soluble copper salt, such as copper nitrate. The chloride dopant may be supplied by, for example, cadmium chloride, although metallic chlorides, such as ferric chloride, should not be used because the remaining metal in the photoconductive powder will increase the dark conductivity. It is also believed that ammonium sulfide may be used in place of hydrogen sulfide. While all process steps were performed at room temperature, to those skilled in the art it is apparent that the process of this invention can be performed within a wide range of temperatures.

The calcined powder is then mixed with a resin and a solvent in order to form a suspension suitable for spraying on conductive surfaces. The photoconductive suspension, once sprayed on a conductive surface and allowed to dry, forms a photoconductor having a high sensitivity in the infrared region, thereby making the coated substrate suitable for use in copy machines utilizing infrared light, such as laser printers.

A typical mixture suitable for spraying on a conductive substrate is comprised of approximately 130 grams of the calcined powder of this invention; 125 grams of AT-50 resin, a 50% solids solution of a thermosetting acyrlic resin manufactured by Rohm and Haas; 330 ml SC-100, an aromatic hydrocarbon solvent with a boiling range of 161°–177° C., manufactured by Central Solvents and Chemicals Co.; 30 ml n-butanol; 25 ml 2-ethoxy ethylacetate; and 2.5 ml of xylene containing 1% DC-200, a silicone oil, manufactured by Dow-Corning Corp. The manufacturer's data sheets for AT-50, SC-100 and DC-200 are hereby incorporated by reference in this application. These ingredients are mixed together and ground for approximately 20 hours, thereby forming a highly homogenous photoconductive solution suitable for spraying on a conductive surface containing particles within the range of less than 1 micron to approximately 3 microns in size.

While specific proportions of specific chemicals have been indicated for a typical mixture suitable for spraying, it is to be understood that a wide range of mixtures comprising the calcinated chalcogenide powder of this invention are possible. For example, the AT-50 resin is used as a binder due to its very high scratch resistance. Other binders may be used. Similarly, while SC-100 is used in one embodiment, other aromatic solvents, such as ethyl toluene and xylene and mixtures thereof, may be used in place of SC-100. Similarly, the n-butanol is used to maintain the solubility of the cross-linking agent of the AT-50. N-pentanol, isopentanol, and 2-ethyl hexanol may be used in place of n-butanol. Similarly, the n-butanol may be replaced with other appropriate chemicals if the AT-50 resin is replaced by other resins. The DC-200 is used as a leveling agent, as is widely known in the paint industry. The leveling agent eliminates "wavy" surfaces by lowering the surface tension of the spray. Other suitable leveling agents may be used in place of or in conjunction with DC-200.

This photoconductor mix is applied to a conductive surface with a draw down rod such as Meyer wire wound rod. Alternatively, the photocondutor spray mix is applied to a conductive surface by spraying with an air gun, such as is widely used in the paint industry. After application, the photoconductor mix is dried by baking at approximately 200° C. for approximately one hour in an air atmosphere. The preferred viscosity for the photoconductor mix, for both wire wound rod application and air gun spraying, is approximately seventeen (17) to twenty-seven (27) seconds as measured with a number 2 Zahn cup. Of course, other viscosities may be used. Typical thicknesses of the photoconductive layer applied to the conductive surface are within the range of 25 to 35 microns, although a wide range of thicknesses are possible. Other coating methods may be used to apply the photoconductor of this invention.

Photoconductors prepared according to this invention, as illustrated above, comprising, by weight, approximately 69% cadmium sulfide, 2% cadmium selenide, 28.5% cadmium carbonate, and 0.5% cadmium oxide, with a 0.6% mole concentration of copper dopant atoms per cadmium atom, have a sensitivity of approximately 24 volts/erg/cm$^2$ at 630 nanometers, 15 volts/erg/cm$^2$ at 780 nanometers, and 7 volts/erg/cm$^2$ at 820 nanometers. A similar photoconductor prepared according to this invention, comprising, by weight, approximately 66% cadmium sulfide, 5% cadmium selenide, 28.5% cadmium carbonate, and 0.5% cadmium oxide, with a 0.6% mole concentration of copper dopant atoms per cadmium atom, has a relative sensitivity as shown by the line labeled A in the FIGURE. By way of comparison, the line labeled B in the FIGURE shows the relative sensitivity versus wavelength of a prior art photoconductor comprising, by weight, approximately 35% cadmium carbonate, 64.5% cadmium sulfide, and 0.5% cadmium oxide, with a 0.6% mole concentration of copper dopant atoms per cadmium atom. Similarly, the line labeled C in the FIGURE shows the relative sensitivity versus wavelength of another prior art photoconductor comprising, by weight, approximately 49.5% cadmium carbonate, 50% cadmium sulfide, and 0.5% cadmium oxide, with a 0.25% mole concentration of copper dopant atoms per cadmium atom. The thicknesses for the photoconductors associated with lines A, B and C of the FIGURE are approximately 22–33 microns.

Photoconductors prepared in accordance with this invention have a dark decay of approximately 40 volts per second. In contrast, prior art cadmium sulfide based photoconductors have a dark decay of approximately 10 to 25 volts per second. The slightly increased dark decay of the photoconductor of this invention compared with prior art cadmium sulfide based photoconductors is not a significant detriment to its use as a photoconductor. Of importance, the dark decay of this invention is significantly less than the dark decay of other prior art photoconductors which are sensitive to infrared light.

The photoconductor of this invention, when formed using AT-50 as the binder, can sustain a surface potential of approximately 30 to 38 volts per micron of thickness before electrical breakdown of the photoconductor layer. This is virtually identical with cadmium carbonate/cadmium sulfide based photoconductors utilizing AT-50 as a binder. The photoconductor of this invention is bipolar, that is, it may be charged alternatively either positively or negatively, and the charge may be removed at selected regions on the photoconductor surface by the application of light.

While specific quantities and amounts of various chemicals have been indicated in the specification, to those skilled in the art many variations and proportions are apparent. It has been specifically found that the photoconductor of this invention may comprise, by weight, approximately 50–80% cadmium sulfide, approximately 0–20% cadmium selenide, approximately 50–20% cadmium carbonate, and up to approximately 2.5% cadmium oxide. Copper dopant can be used up to approximately 2% copper atoms per cadmium atom. Within the ranges given, the preferred ranges are, by weight, approximately 65–73% cadmium sulfide, approximately 1–8% cadmium selenide, approximately 20–34% cadmium carbonate, approximately 0.2 to 1.0% cadmium oxide, and approximately 0.6–1% copper atoms per cadmium atom.

While specific amounts of chloride have been added in the example given, substantial amounts of chloride are removed during filtering, washing and calcining, leaving a small amount of chloride dopant in the photoconductive powder.

I claim:

1. The method for forming a photoconductor having enhanced sensitivity to red and infrared wavelength regions comprising the steps of:

(a) forming a suspension of cadmium carbonate and sufficient cupric chloride to give up to approximately 2% copper atoms per cadmium atom;

(b) adding ammonia to said suspension;

(c) adding hydrogen sulfide gas to convert 50 to 80% of said cadmium carbonate to cadmium sulfide;

(d) adding sufficient cadmium salt to produce the prescribed percentage of cadmium selenide in step (e) and sufficient copper chloride to the conversion product of step (c) to maintain a level of copper doping in the final product of up to approximately 2% copper atoms per cadmium atom, and a source of ammonia to form a mixed slurry; and (e) adding hydrogen selenide gas to the mixed slurry formed in step (d) to form a mixed precipitate including 50–20% cadmium carbonate, 50–80% cadmium sulfide and 0–20% cadmium selenide; and (f) calcining the mixed precipitate from step (e) at a temperature and for a time in an inert atmosphere sufficient to remove volatiles, diffuse the copper dopant in the mixture and to form from 0.05 to 2.5% cadmium oxide in a resultant product of crystallites.

2. The method of claim 1 where the cadmium salt is cadmium nitrate.

3. The method of claim 1 wherein the slurry of cadmium carbonate and ammonia is formed by the precipitation of cadmium carbonate from a cadmium salt and ammonium bicarbonate in an ammonium hydroxide solution.

4. The method as in claim 3 wherein said source of ammonia in step (d) is ammonium hydroxide.

5. The method for forming a photoconductor having enhanced sensitivity to red and infrared wavelength regions comprising the steps of:

(a) mixing cadmium nitrate containing up to approximately 2% copper atoms per cadmium atom, an excess of ammonium bicarbonate, and ammonium hydroxide in a water solution, to react and precipitate cadmium carbonate;

(b) adding additional ammonium hydroxide;

(c) adding sufficient hydrogen sulfide gas to a slurry of said precipitated cadmium carbonate to convert approximately 50–80% of said cadmium carbonate precipitate to cadmium sulfide precipitate;

(d) removing the liquid from said precipitated cadmium carbonate and cadmium sulfide;

(e) mixing said precipitated cadmium carbonate and cadmium sulfide with water, thereby forming a slurry;

(f) adding 0–20% cadmium nitrate and ammonium hydroxide to said slurry formed in step e;

(g) adding hydrogen selenide gas into said slurry of step (f) to convert, said cadmium nitrate and said hydrogen selenide into precipitated cadmium selenide;

(h) removing said precipitated cadmium sulfide, cadmium carbonate, and cadmium selenide from the slurry resulting from step (g);

(i) drying said precipitated cadmium sulfide, cadmium carbonate and cadmium selenide mixture, thereby forming a powder; and (j) calcining said powder in an inert atmosphere to form from 0.05% to 2.5% of cadmium oxide in the precipitates mixture, thereby forming a photoconductive powder comprising crystallites having approximately 50–80% cadmium sulfide, approximately 0–20% cadmium selenide, approximately 50–20% cadmium carbonate, approximately 0.2–1% cadmium oxide and up to approximately 2% copper atoms per cadmium atom.

6. The method for forming a photoconductor having enhanced sensitivity to red and infrared wavelength regions comprising the steps of:

(a) mixing 4.86 moles of cadmium nitrate containing 0.6–1% copper atoms per cadmium atom, 6 moles of ammonium bicarbonate, and 3 moles of ammonium hydroxide in a water solution, thereby precipitating cadmium carbonate;

(b) adding additional 3 to 4 moles of ammonium hydroxide;

(c) adding 3.16 moles of hydrogen sulfide gas, thereby converting a portion of said cadmium carbonate precipitate to cadmium sulfide precipitate, thereby forming a slurry;

(d) adding 0.15 moles cadmium nitrate, approximately 0.6–1% copper atoms per cadmium atoms and 3 to 5 moles of ammonium hydroxide to said slurry;

(e) adding 0.15 moles of hydrogen selenide gas into said slurry, thereby converting said cadmium nitrate and said hydrogen selenide into cadmium selenide;

(f) removing said precipitated cadmium sulfide, cadmium carbonate, and cadmium selenide from the slurry resulting from step (e);

(g) drying said precipitated cadmium sulfide, cadmium carbonate and cadmium selenide mixture, thereby forming a powder; and (h) calcining said powder in an inert atmosphere to form from approximately 0.2 to 1.0% of cadmium oxide in the precipitates mixture, thereby forming a photoconductive powder of crystallites comprising by weight approximately 65–73% cadmium sulfide, approximately 1–8% cadmium selenide, approximately 20–34% cadmium carbonate, approximately 0.2 to 1% cadmium oxide and approximately 0.6–1% copper atoms per cadmium atom.

7. The method of claims 5 or 6 wherein said calcination is in a nitrogen atmosphere at approximately 250°–290° C. for approximately 3–12 hours.

8. The method of claim 7 wherein said calcination is in a nitrogen atmosphere at approximately 270° C. for approximately 8 hours.

* * * * *